US007824009B2

(12) United States Patent
Takei

(10) Patent No.: US 7,824,009 B2
(45) Date of Patent: Nov. 2, 2010

(54) LIQUID EJECTION HEAD

(75) Inventor: Yasunori Takei, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 372 days.

(21) Appl. No.: 12/126,728

(22) Filed: May 23, 2008

(65) Prior Publication Data

US 2008/0291245 A1 Nov. 27, 2008

(30) Foreign Application Priority Data

May 25, 2007 (JP) ..... 2007-139177

(51) Int. Cl.
*B41J 2/15* (2006.01)

(52) U.S. Cl. ..... 347/40; 347/47

(58) Field of Classification Search ..... 347/12, 347/15, 40, 43, 47
See application file for complete search history.

(56) References Cited

U.S. PATENT DOCUMENTS 5,384,587 A * 1/1995 Takagi et al. ..... 347/41
5,620,614 A * 4/1997 Drake et al. ..... 216/27
6,598,951 B2 * 7/2003 Ikemoto et al. ..... 347/13

FOREIGN PATENT DOCUMENTS

JP 10-235874 9/1998
JP 2004-209741 7/2004

* cited by examiner

*Primary Examiner*—Lamson D Nguyen
(74) *Attorney, Agent, or Firm*—Canon USA Inc IP Div

(57) ABSTRACT

A liquid ejection head capable of achieving satisfactory printing without nozzle misfiring in an area close to an end of a nozzle row and droplet misdirection is provided. The ejection orifices, except for dummy orifices, are provided with protrusions. Four operative ejection orifices located close to each of the ends of each ejection orifice row are defined as end-located ejection orifices. Each of the protrusions provided in the end-located ejection orifices has a shorter length than that of the protrusion provided in the ejection orifice located in the central portion of the nozzle row.

8 Claims, 21 Drawing Sheets

LIQUID EJECTION HEAD

BACKGROUND OF THE INVENTION

1. Field of the Invention

This invention relates to a liquid ejection head for ejecting liquid such as ink toward various types of printing media such as a sheet of paper.

2. Description of the Related Art

Currently, the typically employed printing methods of ejecting liquid such as ink include an ink jet printing method. The ink jet printing method employs an electrothermal conversion element (heater) or a piezoelectric element as an ejecting energy generating element to eject liquid. In the use of either element, the liquid can be controlled by an electric signal.

In recent years, a reduction in size of droplets ejected and an increase in the number of nozzles in the liquid ejecting head have been developed in response to a growing need for increasing the image quality of printing. Along with this, an increasingly serious matter is the effects on printing of droplets not contributing to the printing, in addition to droplets ejected for printing. Specifically, upon the ejection of the liquid, the stream of liquid breaks up to form the main droplets and the sub droplets (hereinafter referred to as "satellite droplets"). The main droplets land on the desired location of the printing medium, whereas the landing location of the satellite droplets may possibly not be controlled. In the case of conventional low image-quality printing, the effects of the satellite droplets on print are almost negligible. However, with an increase in high image-quality printing, the reduction in image quality caused by the satellite droplets becomes increasingly obvious. In addition, small-sized satellite droplets lose their velocity before reaching the printing medium to form ink drops floating in the air (hereinafter referred to as "mist"). The mist may stain the printing apparatus. In turn, the stain in the printing apparatus may be transferred to the printing medium to stain the printing medium.

As a method for preventing the satellite droplet formation, Japanese Patent Laid-Open No. H10-235874 discloses a method of providing an ejection orifice formed in a shape other than a circle in order to reduce the number of satellite droplets. In the method disclosed in Japanese Patent Laid-Open No. H10-235874, the ejection orifice has a long periphery because it has a shape other than a circular shape.

In liquid ejection from a conventional ink jet print head, when the nozzle is re-operated for printing after a rest over a fixed time period, the first ink drop may possibly not be ejected or alternatively may possibly, without traveling straight, land on an unintended place in the printing medium. Causes of such uneven liquid ejection after the lapse of a fixed time period include an increase in ink viscosity because of the evaporation of the ink in the nozzle during the printing rest.

One of the factors in uneven ejection after a lapse of a predetermined time period involves a flow resistance at the ejection orifice and the like. That is, a high flow resistance results in uneven ink ejection. As a result, the ink cannot be smoothly ejected after the lapse of a predetermined time period.

When an ejection orifice has a long periphery as disclosed in Japanese Patent Laid-Open No. H10-235874, the flow resistance increases during ejection. For the purpose of reducing the number of satellite droplets, the provision of a protrusion in the ejection orifice to increase the periphery of the orifice is effective. However, the protrusion causes an increase in flow resistance. The provision of the protrusion may hinder the ejection smoothness after the lapse of a predetermined time period. In other words, a reduction in the number of satellite droplets and the improvement of the ejection smoothness after the lapse of a predetermined time period counteract each other. However, an important element for the achievement of high grade print is to improve the ejection smoothness after the lapse of a predetermined time period while the number of satellite droplets is reduced by use of a non-circular shaped ejection orifice.

A method for improving the ejection smoothness after the lapse of a predetermined time period is disclosed in, for example, Japanese Patent Laid-Open No. 2004-209741 which discloses a method of preventing the ejection from deteriorating after the lapse of a predetermined time period in which holes (moisture retention holes) of a size not allowing ink to be ejected are provided around an ejection orifice, in order for the ink to be evaporated from these holes, so that the moisture around the ejection orifice is maintained.

Japanese Patent Laid-Open No. 2004-209741 discloses a structure having moisture retention holes of 3 μm to 4 μm in diameter arranged around the ejection orifice. Because of the very small diameter of each moisture retention hole itself, the ink is apt to solidify in the moisture retention holes during the time when the printing operation is not being performed. Even if a sucking recovery operation is performed for preventing the ink from solidifying, since the resistance is smaller in the ejection orifice than in the moisture retention holes, which are smaller in diameter than the ejection orifice, the ink is sucked from the ejection orifice. This makes it difficult to remove the ink solidifying in the moisture retention holes. Thus, the provision of the moisture retention holes fall short of reducing the amount of ink evaporated from the ejection orifice. In view of the various environments in which the liquid ejection head is mounted, the moisturizing measures to improve the ejection smoothness after the lapse of a predetermined time period fail to deal with many situations.

Particularly, such defective conditions deteriorating smooth ink-ejection after the lapse of a predetermined time period easily occur in the area close to the end of a nozzle row. For this reason, nozzle misfiring at the nozzle ends or droplet misdirection (deflection in the ejected direction) may possibly reduce the print quality.

SUMMARY OF THE INVENTION

The present invention is directed to a liquid ejection head capable of achieving satisfactory printing without nozzle misfiring in an area close to an end of a nozzle row and droplet misdirection.

According to an aspect of the present invention, a liquid ejection head includes a plurality of ejection orifices facilitating ejecting a predetermined amount of liquid therefrom. The plurality of ejection orifices are shaped with reference to a single opening shape defined a reference opening shape. The plurality of ejection orifices are arranged to form ejection orifice rows, and each ejection orifice of the plurality of ejection orifices located in a portion of each ejection orifice row other than end portions of the ejection orifice row close to ends thereof is provided with a protrusion protruding into a center of the ejection orifice of the reference opening shape, whereby the ejection orifice has a longer periphery than the periphery of each ejection orifice located in the end portions of the ejection orifice row.

According to the present invention, each of the ejection orifices other than the ejection orifices located close to an end of each row of ejection orifices has protrusions formed therein, thus being enabled to have a greater length of periphery than that of the ejection orifices located close to the end of the ejection orifice row. As a result, it is possible to improve the smoothness of the ink ejection from the end-located ejection orifices after the lapse of a predetermined time period, resulting in the achievement of satisfactory printing without nozzle misfiring in an area close to the end of the nozzle row and droplet misdirection.

Further features of the present invention will become apparent from the following description of exemplary embodiments (with reference to the attached drawings).

DESCRIPTION OF THE EMBODIMENTS

First Embodiment

Figure 20:
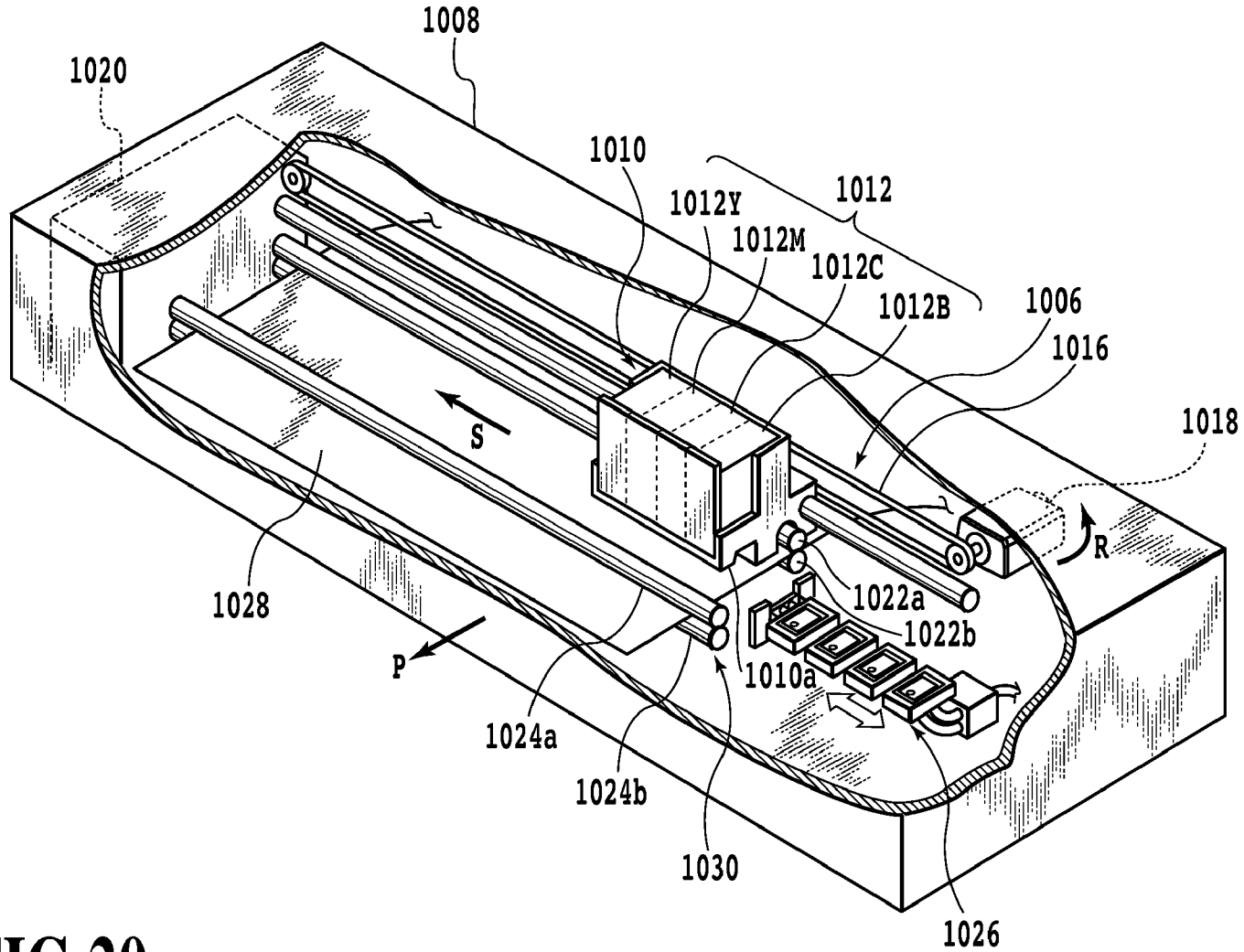
FIG. 20 is a schematically perspective view illustrating a major portion of an ink-jet printing apparatus to which the liquid ejection head of the present invention is applicable.

A first embodiment of the present invention will be described below with reference to the drawings. FIG. 20 is a schematically perspective view illustrating a major portion of an ink-jet printing apparatus to which the liquid ejection head of the present invention is applicable. The ink-jet printing apparatus includes a casing 1008 and a transport unit 1030 provided inside the casing 1008 in the longitudinal direction for feeding a paper sheet 1028, which is a recoding medium, in a direction indicated by the arrow P (hereinafter referred to as "direction P"). The ink-jet printing apparatus further includes a printing unit 1010 and a moving drive unit 1006. The printing unit 1010 is movable in a direction indicated by the arrow S (hereinafter referred to as "direction S") at approximately right angles to the direction P, which is the direction of carrying the paper sheet 1028. The moving drive unit 1006 is capable of shuttling the printing unit 1010.

The transport unit 1030 includes a pair of approximately parallel roller units 1022*a* and 1022*b*, another pair of approximately parallel roller units 1024*a* and 1024*b*, and a drive unit 1020 for driving these pairs of roller units. Under the operation of the drive unit 1020, the paper sheet 1028 is intermittently fed in the direction P while being nipped between the roller units 1022*a* and 1022*b* and then between the roller units 1024*a* and 1024*b*.

The moving drive unit 1006 is equipped with a belt 1016 and a motor 1018 for operating the belt 1016 in the forward direction and the backward direction. The belt 1016 is placed approximately parallel to the roller units 1022*a* and 1022*b* and linked to a carriage member 1010*a* of the printing unit 1010.

Upon the activation of the motor 1018 to rotate the belt 1016 in a direction indicated by the arrow R, the carriage member 1010*a* of the printing unit 1010 moves by a predetermined amount of travel in the direction S. When the belt 1016 is rotated in the direction opposite to the direction R under the operation of the motor 1018, the carriage member 1010*a* of the printing unit 1010 moves by a predetermined amount of travel in the direction opposite to the direction S. A recovery unit 1026 is provided at an end of the moving drive unit 1006 to allow for the ejection recovery processing for the printing unit 1010. The recovery unit 1026 is located at a position corresponding to the home position of the carriage member 1010*a* and facing the ink ejection orifice array of the printing unit 1010.

The printing unit 1010 is loaded with ink-jet cartridges (hereinafter referred to simply as "cartridges") 1012Y, 1012M, 1012C, and 1012B of different colors from each other, which are fitted detachably from the carriage member 1010*a*.

Figure 19:
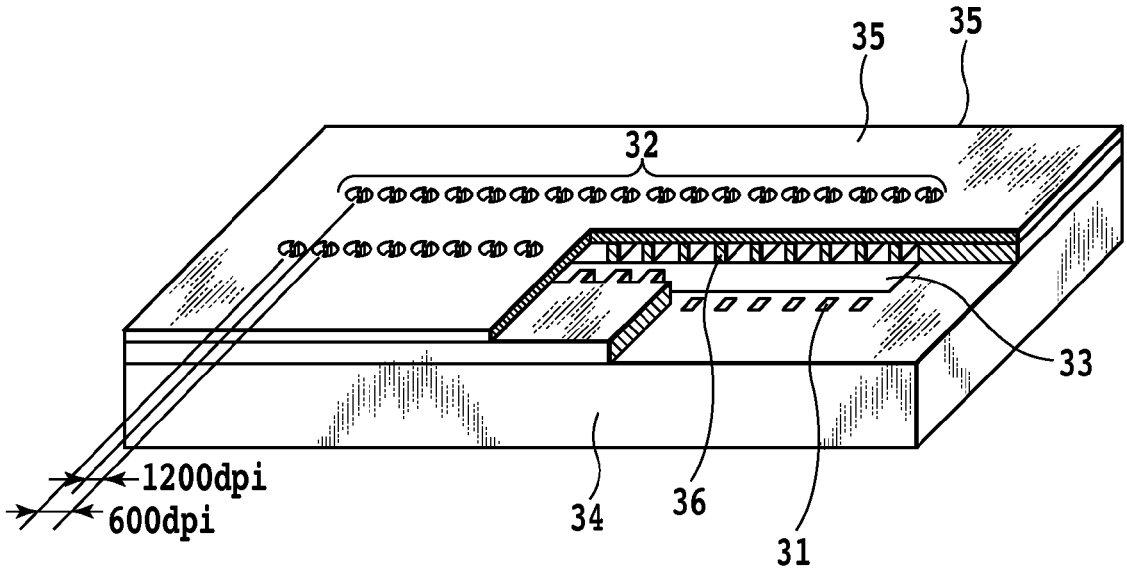
FIG. 19 is a schematically perspective view illustrating a major portion of the liquid ejection head illustrating a basic mode of the present invention.

FIG. 19 is a schematic perspective view illustrating a major portion of the liquid ejection head illustrating a basic mode of the present invention. A substrate 34 includes electrothermal conversion elements 31 (hereinafter referred to as "heaters") and an ink feed port 33 having an elongated groove-shaped through-hole which serves as a common liquid chamber. The heaters 31, which are a thermal energy generating units, are arranged in line at 600-dpi intervals along the each of the opposing sides of the ink feed port 33 in the longitudinal direction in such a manner as to zigzag across the ink feed port 33. The substrate 34 has ink passage walls 36 formed thereon for providing an ink passage. In turn, on the ink passage walls 36 an ejection orifice plate 35 is provided. Ejection orifice rows 32 are provided in the ejection orifice plate 35.

Figure 18:
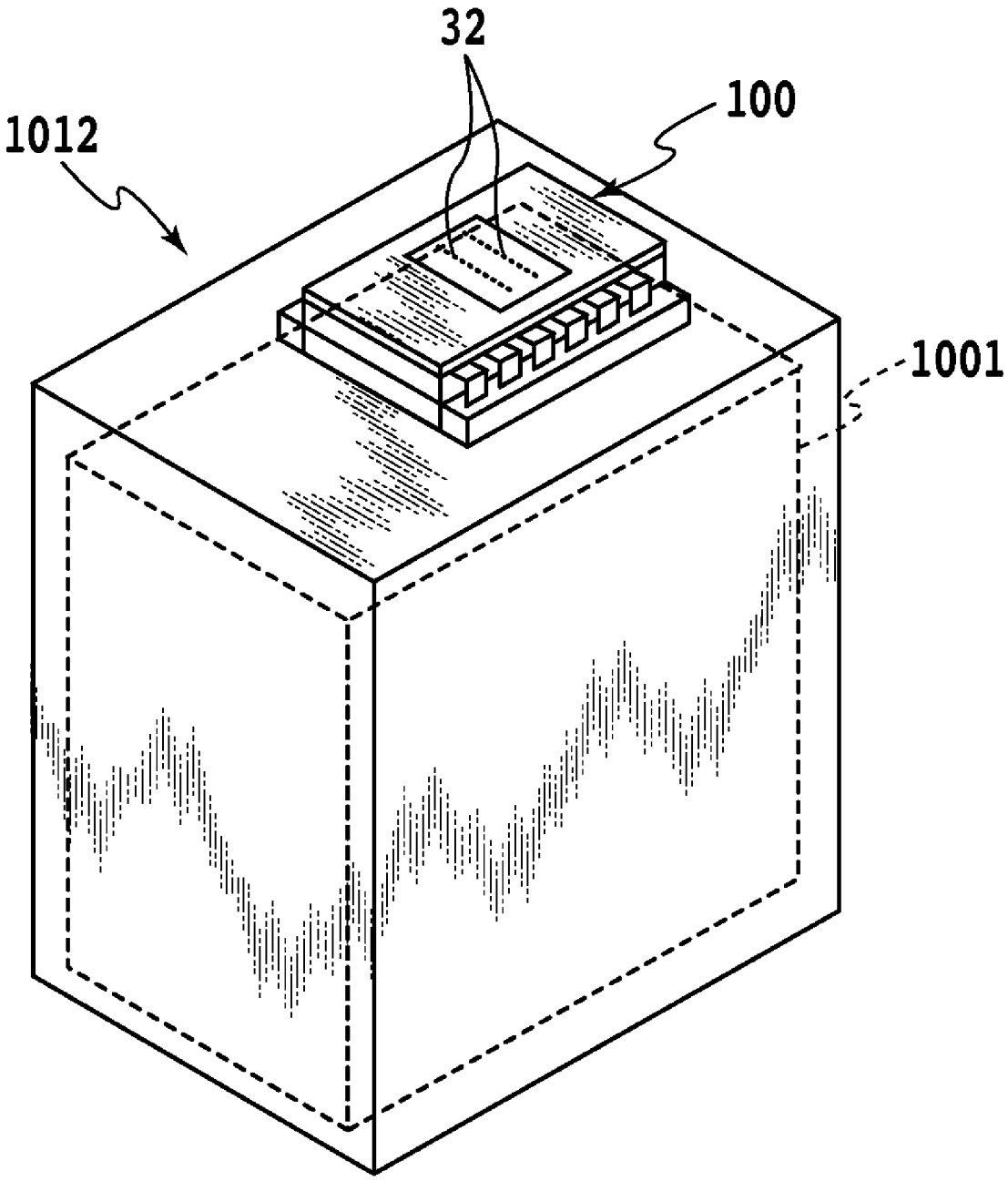
FIG. 18 is a diagram illustrating an example of an ink-jet cartridge which is mountable on an ink-jet printing apparatus.

FIG. 18 is a diagram showing an example of an ink-jet cartridge mountable on the aforementioned ink-jet printing apparatus. The cartridge 1012 employed in the embodiment is of a serial type. The primary part of the cartridge 1012 includes an ink-jet print head (hereinafter referred to as "liquid ejection head") 100 which is similar to that shown in FIG. 19, and a liquid tank 1001 containing liquid such as ink. The liquid ejection head 100 having ejection orifice rows 32 of a plurality of orifices formed therein for ejecting a predetermined amount of liquid corresponds to one described in each of the following embodiments. The liquid such as ink is guided into the common liquid chamber (see FIG. 19) of the liquid ejection head 100 through the liquid feed passage (not shown) from the liquid tank 1001. The cartridge 1012 of the embodiment is structured such that the ink-jet print head 100 and the liquid tank 1001 are integrally formed, and the liquid can be supplied into the liquid tank 1001 as required. In another adoptable structure for the cartridge, the liquid tank 1001 may be detachably linked to the liquid ejection head 100 to allow for replacement. The following is the description of a specific example of the aforementioned liquid ejection head mountable on the ink-jet printing apparatus structured as described above.

Figure 1:
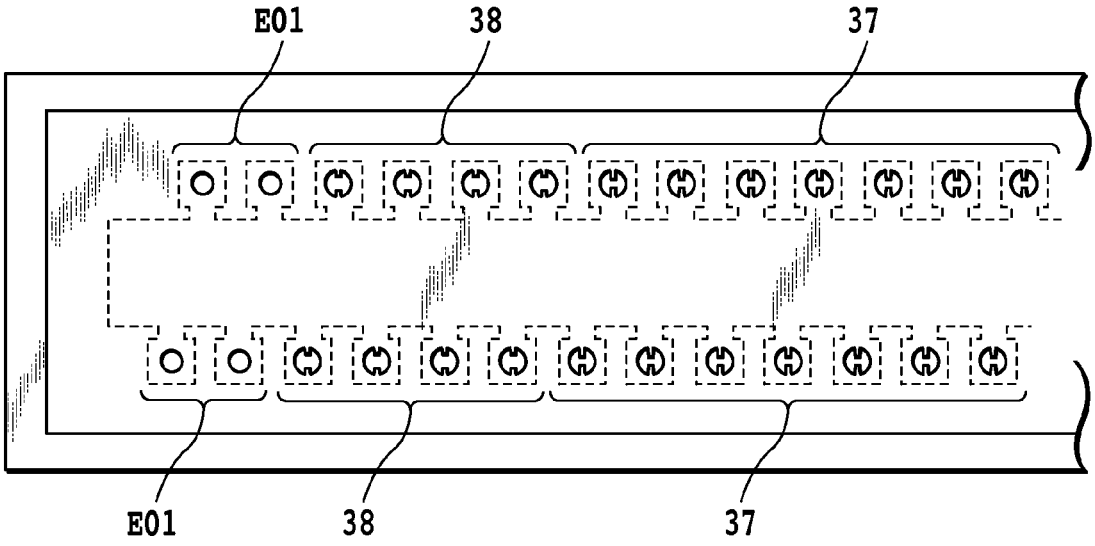
FIG. 1 is a diagram illustrating a part of an ejection orifice of the liquid ejection head of a first embodiment of the present invention.

FIG. 1 is a diagram illustrating some of the ejection orifices formed in the liquid ejection head 100 of the embodiment. FIG. 1 shows four ejection orifices E01 which are part of a plurality of ejection orifices belonging to ejection orifice rows in which the ejection orifices are arranged in a zigzag form (two ejection orifices on each of the opposing sides of the ink feed port 33). The four ejection orifices E01 are dummy orifices to which the ink is supplied but not ejected therefrom. In the embodiment, all the ejection orifices other than the dummy orifices E01 have an opening shape that is non-circle with protrusions. The non-circular ejection orifices are shaped based on the shape of the dummy orifice E01, that is, each of the non-circular ejection orifices can be achieved by providing protrusions in the dummy orifice E01.

Figure 2A:
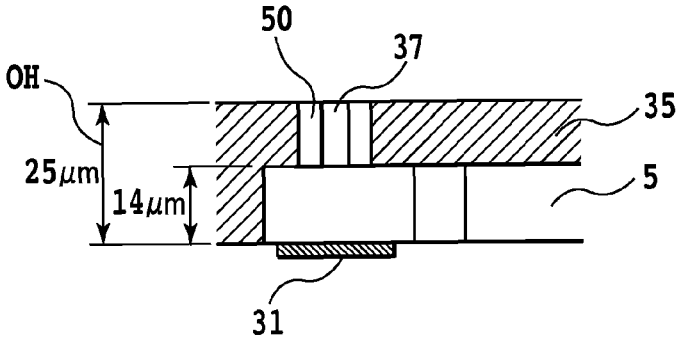
FIG. 2A is a sectional view illustrating an ejecting part of a nozzle having an ejection orifice with elongated protrusions.
Figure 2B:
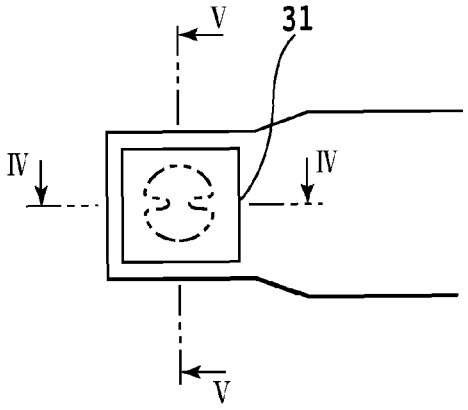
FIG. 2B is a front view of the nozzle of the liquid ejection head in FIG. 2A.
Figure 2C:
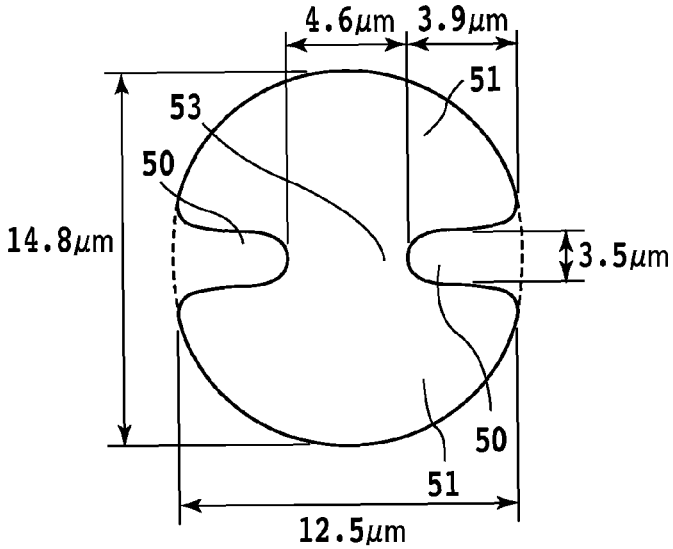
FIG. 2C is a diagram illustrating the shape of the ejection orifice of the liquid ejection head in FIG. 2A.
Figure 3A:
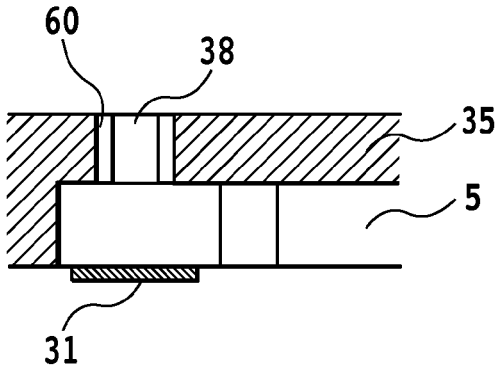
FIG. 3A is a sectional view illustrating an ejecting part of a nozzle having an ejection orifice with shorter protrusions.
Figure 3B:
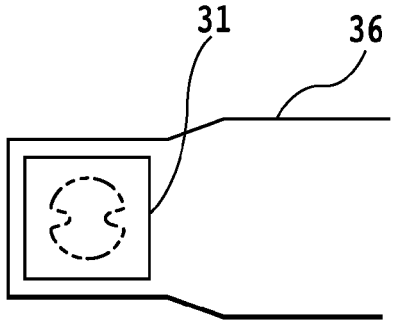
FIG. 3B is a front view of the nozzle of the liquid ejection head in FIG. 3A.
Figure 3C:
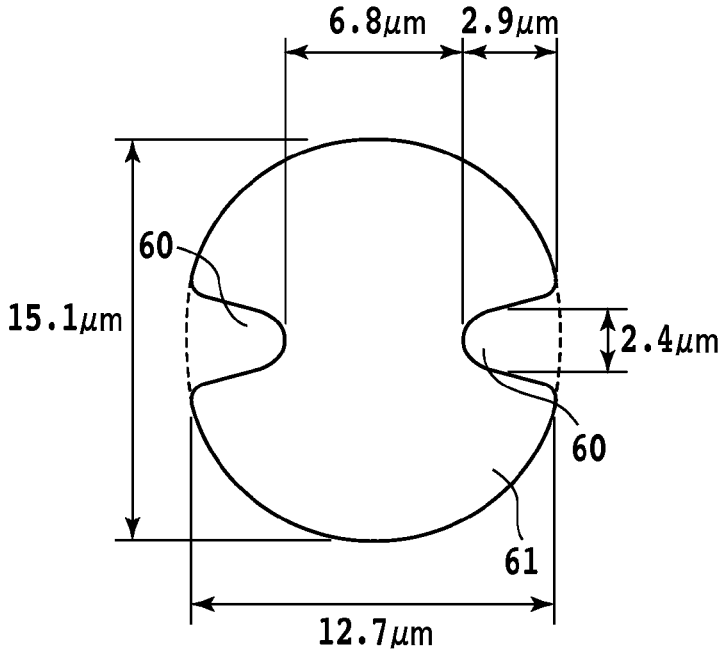
FIG. 3C is a diagram illustrating the shape of the ejection orifice of the liquid ejection head in FIG. 3A.

FIGS. 2A to 2C are diagrams illustrating an ejection orifice with long protrusions according to the embodiment. FIGS. 3A to 3C are diagrams illustrating an ejection orifice with shorter protrusions according to the embodiment. According to a study of the inventors of the present invention, relating to each of the ejection orifices with protrusions, a pair of opposing protrusions extending from the outer edge (indicated with a dotted line in each FIG. 2C, 3C) of each ejection orifice toward the center of the orifice is changed in length. When the length of the pairs of protrusions is varied, the balance between the capability of reducing the mist and the ejection smoothness after the lapse of a predetermined time period can be changed. When the length of the protrusion is increased, the ejection orifice provided with the protrusions increased in length according to the embodiment is capable of reducing the mist, but this reduces the ejection smoothness after the lapse of a predetermined time period because of the increase in the periphery of the orifice. Because of these characteristics, the control of the capabilities of the ejection orifices is achieved by changing the length of their protrusions.

Specifically, in the case of a typical circular-shaped ejection orifice, upon being ejected, the liquid forms a droplet with a column-shaped tail (hereinafter referred to as "ink tail"). Then, the ink tail breaks off before reaching the printing medium, whereby the droplet without the tail reaches the printing medium. At this stage, besides the droplet (main droplet) which is primarily intended to reach the printing medium, secondary droplets, called satellite droplets, may possibly be formed. To briefly sum up the process of forming the satellites, this is caused by the fact that "a liquid column of a certain length is formed upon the ejection of the liquid and then breaks into a plurality of droplets which are then rounded by the surface tension". Typically, because each of the satellite droplets has a smaller size and a slower speed than the main droplet, the satellite droplets land on a location in the printing medium or another liquid receptor deflected from the landing location of the main droplet, resulting in the factor of reducing the print quality.

By contrast, the ejection of a drop from a non-circular-shaped ejection orifice with protrusion will be described below, in which the ejection orifice 37 with the long protrusions is described, but the same holds good for the ejection orifice 38 with the short protrusions. Two protrusions 50 protrude into the ejection orifice 37, so that the ejection orifice 37 has a shape appearing to be divided into two orifices. This makes it possible to control the amount of liquid ejected from the two openings 51 formed in the ejection orifice, and the amount of liquid ejected from a slit 53 created between the protrusions 50.

Regarding the liquid ejected from the ejection orifice 37, a relatively large amount of liquid is ejected from the two openings 51 performing the main ejection, whereas a relatively small amount of liquid is ejected from the slit 53 connecting to the openings 51.

According to a study of the inventors, it is found that defective conditions deteriorating smooth ink ejection after the lapse of a predetermined time period easily occur, in particular, in an area close to the end of each nozzle row. Actually, ink is ejected in the environments in which defective conditions deteriorating smooth ink ejection after the lapse of a predetermined time period tend to easily occur. This shows that an ejection failure, such as a nozzle misfiring or a deviation in landing location, which is caused by a reduction in the ejection smoothness after the lapse of a predetermined time period, starts from the end of each nozzle row. Possible causes of this are a difference in the amount of ink evaporated from the ejection orifice between the central portion and an end portion of each nozzle row, a difference in the amount of ink supply between the ejection orifices, and the like.

To avoid this, the embodiment provides a structure that makes it difficult for the end of each nozzle row to have defective conditions deteriorating smooth ink ejection after the lapse of a predetermined time period. Specifically, the ejection orifices with the longer protrusions are employed as the end-located ejection orifices which are the eight ejection orifices, except for the dummy orifices, from each of the opposing ends of the nozzle rows (four ejection orifices on each of the opposing sides of the ink feed port 33). The ejection orifices with the protrusions of a regular length are employed as all the ejection orifices located between the above-described two sets of end-located ejection orifices respectively located close to the opposing ends. By this arrangement, related to the ink ejection after the lapse of a predetermined time period, the ink can be more easily ejected from the ejection orifices located close to an end of each nozzle row than from the ejection orifices located in the central portion. As a result, it is possible to inhibit the defective conditions occurring close to the end of the nozzle row, which deteriorates smooth ink ejection after the lapse of a predetermined time period.

FIG. 2A is a sectional view illustrating an ejecting portion of a nozzle having an ejection orifice 37 with long protrusions as described above. In FIG. 2A, the height of the liquid passage 5 is 14 μm, and the distance from the heater 31 to the surface of the ejection orifice plate 35 is 25 μm. A pair of protrusions 50 are provided in the ejection orifice 37. FIG. 2B is a front view of the nozzle. The size of the heater 31 which is an ejection energy generating element is 17.6×17.6 μm. The ink passage walls 36 are provided for fluidal disconnection between adjacent nozzles. FIG. 2C is a diagram illustrating the shape of the ejection orifice 37. The width of each of the pair of protrusions 50 provided in the ejection orifice 37 is 3.5 μm. The length of the protrusion 50 is 3.9 μm. The distance between the opposing tips of the pair of protrusions 50 is 4.6 μm. The pair of protrusions 50 are provided so as to face each other in a direction at right angles to the scan direction of the liquid ejection head 100 in the apparatus in which the liquid ejection head 100 is mounted.

FIG. 3A is a sectional view illustrating the ejecting portion of a nozzle with an ejection orifice 38 with short protrusions as described earlier. FIG. 3B shows a front view of the nozzle. FIG. 3C is diagram illustrating the shape of the ejection orifice. The width of each of the pair of protrusions 60 provided in the ejection orifice 38 is 2.4 μm. The length of the protrusion 60 is 2.9 μm. The distance between the opposing tips of the pair of protrusions 60 is 6.8 μm. The length of each protrusion in the ejection orifice 38 is shorter than that in the ejection orifice 37 located in the central portion of the ejection orifice row, so that the length of the periphery of the ejection orifice 37 is shorter than that of the ejection orifice 38. The thickness of the protrusion 60 is equal to the thickness of the ejection orifice plate. As to the values of physical properties of the ink used in the embodiment, the degree of viscosity is 2.4 cps and the surface tension is 33 dyn/cm.

TABLE 1

| Protrusion length | Print resting time | | |
|---|---|---|---|
| [μm] | 0.9 s | 1.8 s | 2.7 s |
| 2.9 | ○ | ○ | ○ |
| 3.3 | ○ | ○ | x |
| 3.9 | ○ | x | x |

Table 1 shows the results of the measurements of whether or not the ink is normally ejected from the ejection orifices having the protrusions of three different lengths when the printing operation is restarted after the lapse of a predetermined print resting time. When the printing operation has been restarted after being halted for 1.8 s, the ejection orifice with the protrusions each having a length of 3.9 μm caused nozzle misfiring, irregular ejection leading to a deviation in landing position, and the like. On the other hand, the ejection orifice with the protrusions each having a length of 2.9 μm could provide normal ejection even after the printing operation had been halted for 2.7 s.

Next, a description will be given of the principle governing the ink ejection from the ejection orifice with the protrusions according to the embodiment. Ejection methods include a bubble jet (BJ) ejection system in which no communication of an air bubble with the atmosphere occurs and a bubble-through jet (BTJ) ejection system in which communication of an air bubble with the atmosphere occurs, to both of which the present invention is applicable. The ejection principle will be described below taking each of the ejection methods as examples.

(BJ Ejection System)

Figure 4:
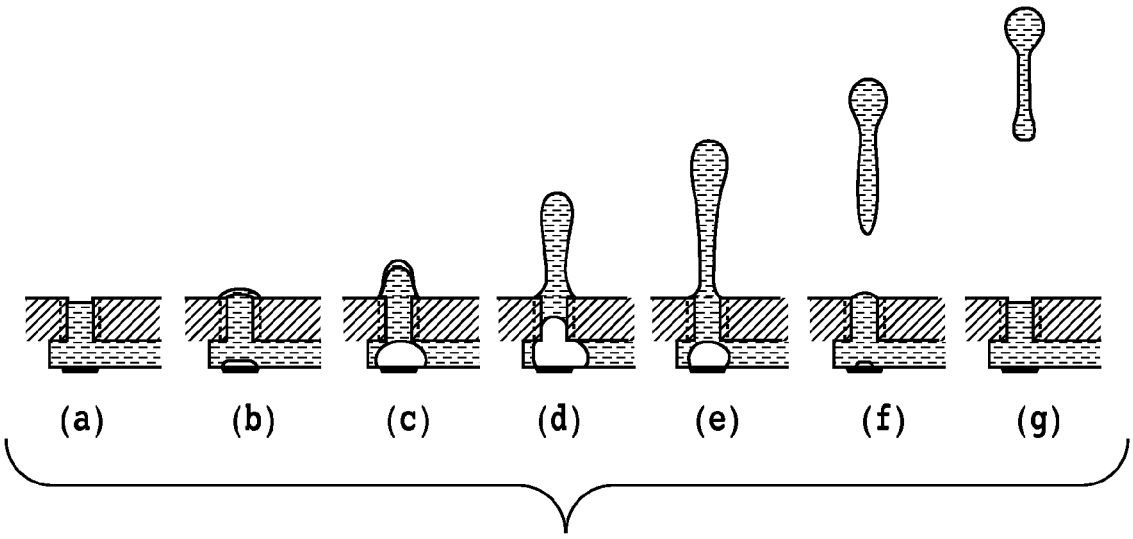
FIG. 4 is a diagram illustrating the ejection sequence at each stage in a bubble jet ejection system.
Figure 5:
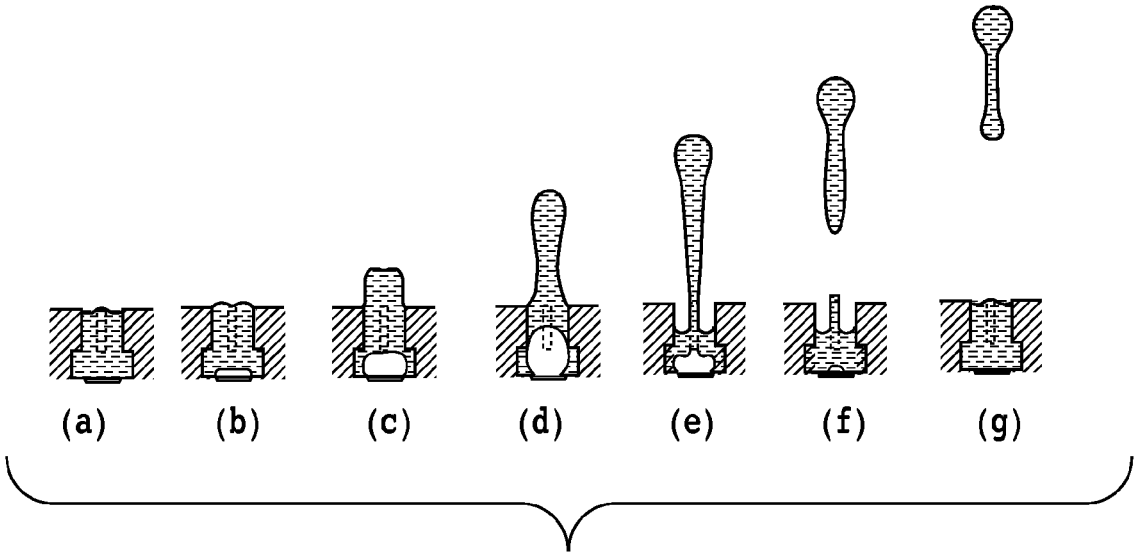
FIG. 5 is another diagram illustrating the ejection sequence at each stage in a bubble jet ejection system.

FIGS. 4 and 5 are diagrams illustrating the ejection sequence at each stage in the bubble jet (BJ) ejection system in which no communication of an air bubble with the atmosphere occurs in the embodiment. The ejection stages (a) to (g) in FIG. 4 are sectional views of the head taken along the line IV-IV in FIG. 2B. The ejection stages (a) to (g) in FIG. 5 are sectional views of the head taken along the line V-V in FIG. 2B. The steps at the ejection stages (a) to (g) in FIG. 4 correspond to the steps at the ejection stages (a) to (g) in FIG. 5.

The air-bubble growing steps from the state at the ejection stage (a) in FIG. 4 to the maximum bubble formation state at the ejection stage (d) in FIG. 4 are the same as the conventional ones, and the description is omitted. The air bubble in the maximum bubble formation state at the ejection stage (d) in FIG. 4 grows to penetrate the inside of the ejection orifice.

The pressure in the gas portion of the air bubble in the maximum bubble formation state is sufficiently lower than the atmospheric pressure. For this reason, after this, the volume of the air bubble decreases, so that the liquid around the air bubble is rapidly drawn into an area occupied by the air in the atmosphere. This liquid flow causes the liquid existing inside the ejection orifice to flow back toward the heater. However, because of the shape of the ejection orifice as shown in FIG. 2C or 3C, the liquid is positively drawn from the areas of the ejection orifice which are without the protrusions which are low fluid resistance portions. AT this stage, the liquid level formed on the low fluid resistance portions between the inner face as the side face of the ejection orifice and the column-shaped liquid is largely depressed in a recess shape toward the heating element. On the other hand, the liquid tends to remain at this point in the area between the protrusions which are a high fluid resistance portion. As a result, the liquid located in the ejection orifice close to the open end of the ejection orifice as shown in the ejection stage (e) in FIG. 4 remains in such a manner as to form a liquid level (liquid film) only in the area between the protrusions which are the high fluid resistance portion. That is, while the level of the liquid linked to the column-shaped liquid extending out from the ejection orifice is held in the high fluid resistance area (first area), the liquid in the ejection orifice is drawn toward the heater in a plurality of low fluid resistance areas (second area). As a result, a liquid level depressed in a largely recess shape is formed in a plurality (two in the embodiment) of low fluid resistance portions in the ejection orifice. The state of the column-shaped liquid (liquid column) 52 at this point is three-dimensionally shown in FIG. 6A, FIG. 6B and FIG. 6C.

Figure 6A:
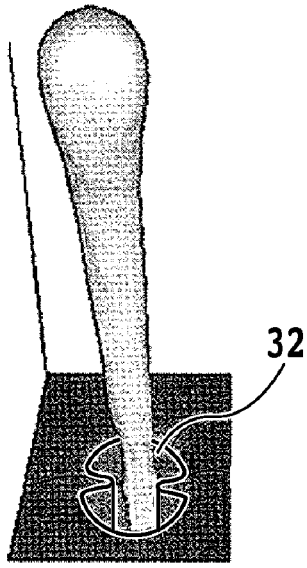
FIG. 6A is a perspective view of a simulation of a liquid column when viewed from a direction at right angles to the protrusion.
Figure 6B:
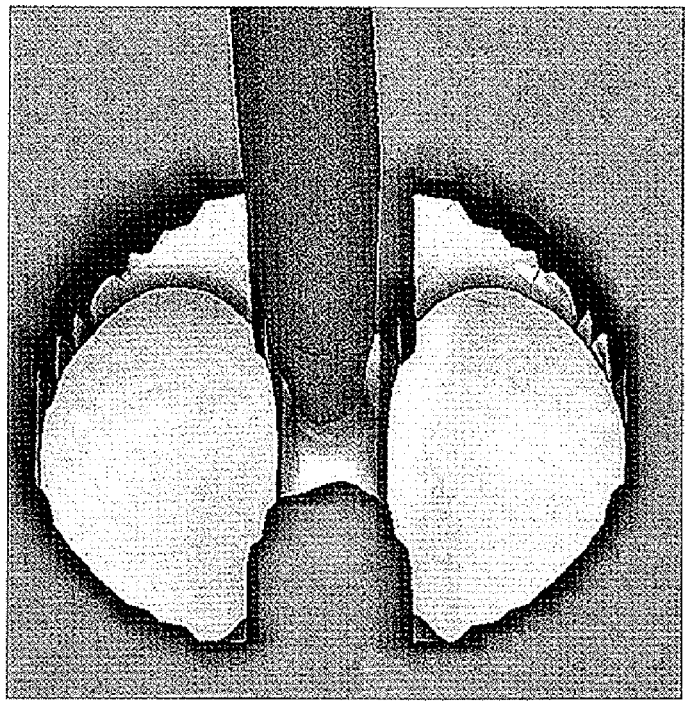
FIG. 6B is an enlarged perspective view of a simulation of a "constricted part" of the liquid column when viewed from the protrusion.

At this point, the amount of liquid remaining in the high fluid resistance portion between the protrusions is lower than the amount of liquid determined by the diameter of the liquid column. For this reason, the liquid column is partly decreased in diameter by the protrusions to form a "constricted part". It should be noted that FIG. 6A is a perspective view of a simulation of a liquid column when viewed from a direction at right angles to the protrusion. FIG. 6B is an enlarged perspective view of a simulation of a "constricted part" of the liquid column when viewed from the protrusion. The "constricted part" formed at the base of the liquid column and the tops of the protrusions are confirmed from the two directions shown in FIG. 6A and FIG. 6B.

Figure 6C:
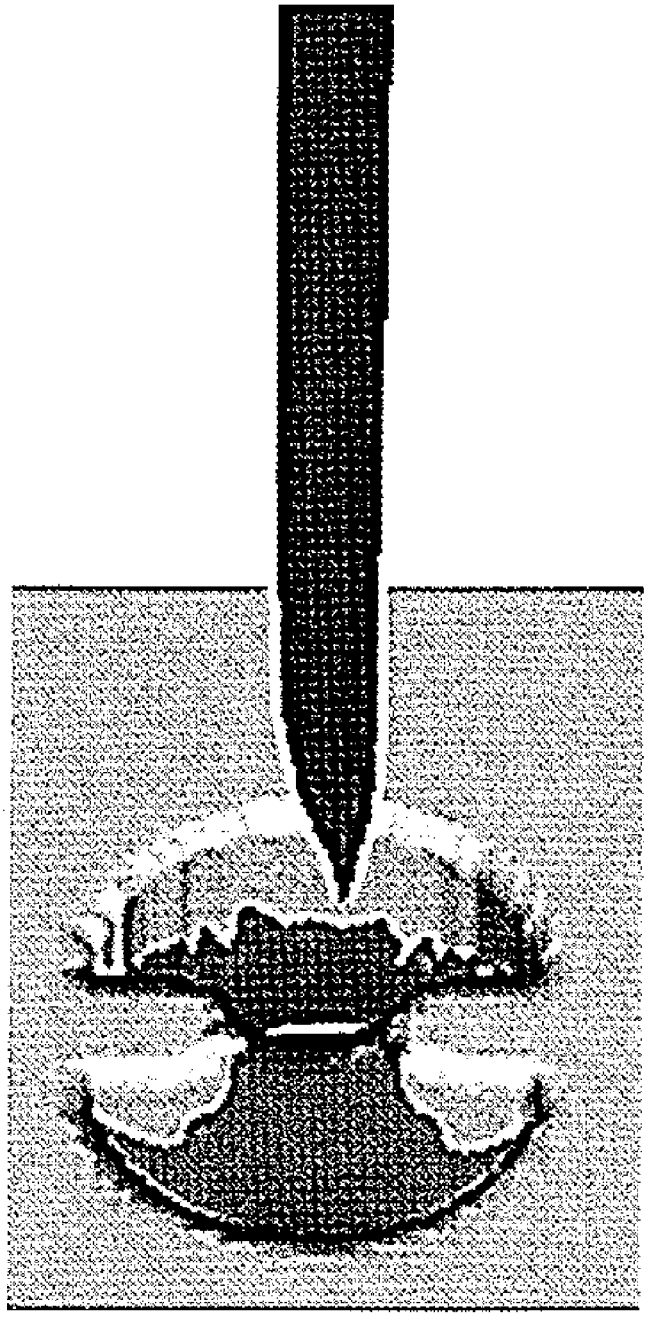
FIG. 6C is an enlarged diagram illustrating the ejection orifice in FIG. 6A.

Then, while the level of the liquid (liquid film) linked to the liquid column extending out from the ejection orifice is held in the high fluid resistance area between the protrusions, the liquid column extending out from the ejection orifice is cut off at the constricted part of the liquid column formed in the high fluid resistance area of the tops of the protrusions (FIG. 6C). The separation of the ejected liquid at this stage makes it possible to shorten the separation time by 1 μsec to 2 μsec or more as compared with the conventional separation time. Specifically, if the ejection velocity of the droplet is 15 m/sec, the length of the tail is shortened by 15 μm to 30 μn or more. A force drawing the liquid between the protrusions toward the heater in association with the bubble shrinkage hardly acts on the liquid between the protrusions. Because of this, there is no situation in which the ejected liquid flies in a direction opposite to the velocity vector at which it intends to fly as in conventional cases. Accordingly, as compared with the conventional cases, the velocity of the tail portion of the droplet is sufficiently increased. The phenomenon of a liquid-column-shaped portion of the ejected liquid extending to be elongated does not substantially occur. As a result, the ejected liquid smoothly separates, and the mist which occurs in large amounts when the ejected liquid (liquid column) separates is dramatically inhibited.

Figure 7:
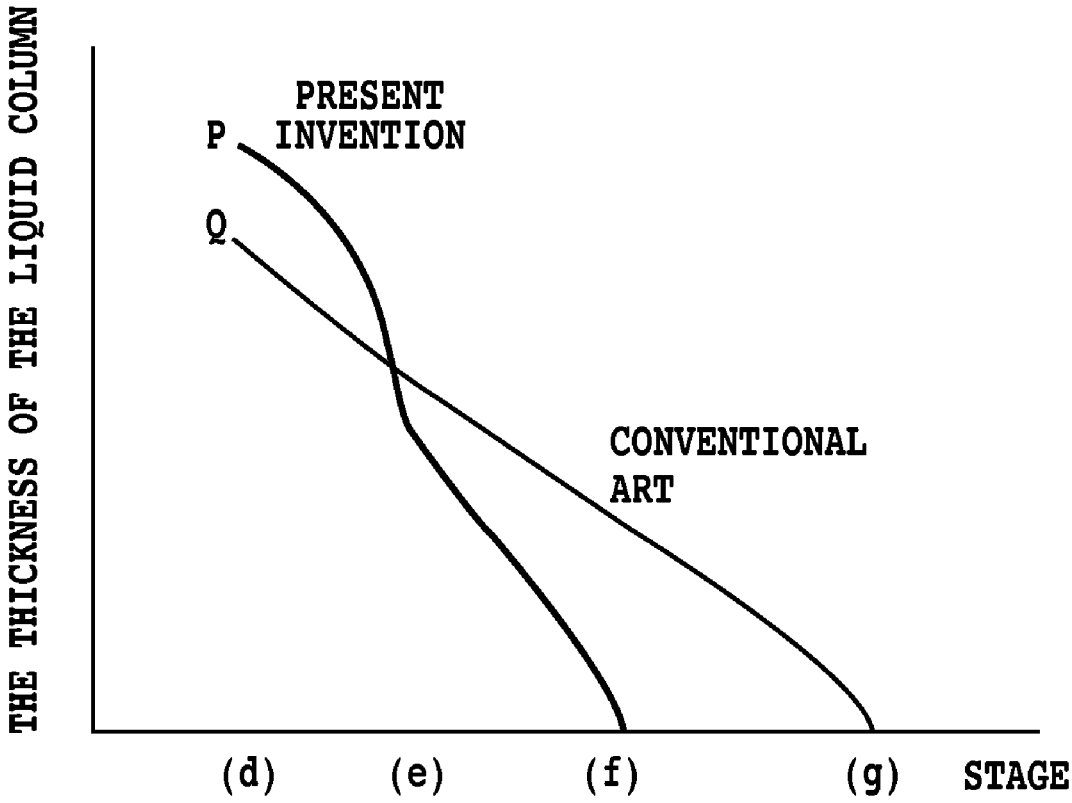
FIG. 7 is a graph showing the relationship between the thickness of the liquid column and each stage in the ejection sequence in the embodiment.

FIG. 7 is a graph showing the relationship between the thickness of the liquid column and each stage in the ejection sequence in the embodiment. The graph shows the relationship between the stages in the ejection sequence and the minimum diameters of the liquid column indicated by the graph P representing the present invention and by the graph G representing conventional art. It should be noted that the minimum diameter of the liquid column means a diameter of a portion having the smallest cross-section in the ejection direction of the liquid column extending out from the ejection orifice, except for the ball portion which is the main droplet. Horizontal scales (d) to (g) in FIG. 7 correspond to the stages in FIG. 4.

The difference in liquid-column diameter in the initial stage in FIG. 7 is attributable to a point that the ejection orifice according to the present invention has the maximum diameter longer than that of a conventional ejection orifice because it has a shape resembling that when the conventional ejection orifice is divided into two half circles and protrusions are inserted between the two half circles. As seen from FIG. 7, in the conventional structure, with the passage of time, the minimum diameter of the liquid column decreases at almost a constant rate. However, it is seen that, in the structure of the present invention, the rate of change of the minimum diameter of the liquid column with the passage of time rapidly changes in the bubble shrinkage process. The reason for this rapid change can be thought that the bubble shrinkage causes the retraction of a part of the meniscus, which then causes a rapid decrease in the amount of liquid in contact with the liquid column held by the protrusions, resulting in a constricted part being formed at the base of the liquid column. Thus, it is through that the separation time for the ejected liquid is shortened as compared with that in conventional art because the thickness of the liquid column becomes extremely small in the state (e).

(BTJ Ejection System)

Figure 8:
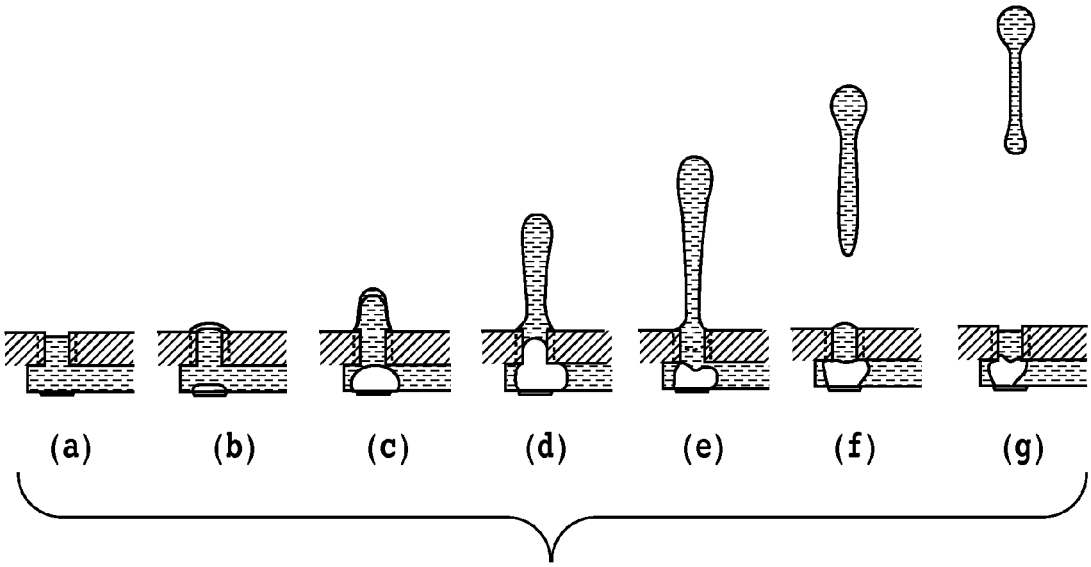
FIG. 8 is a diagram illustrating the ejection sequence at each stage in a bubble-through jet ejection system in which communication of an air bubble with the atmosphere occurs.
Figure 9:
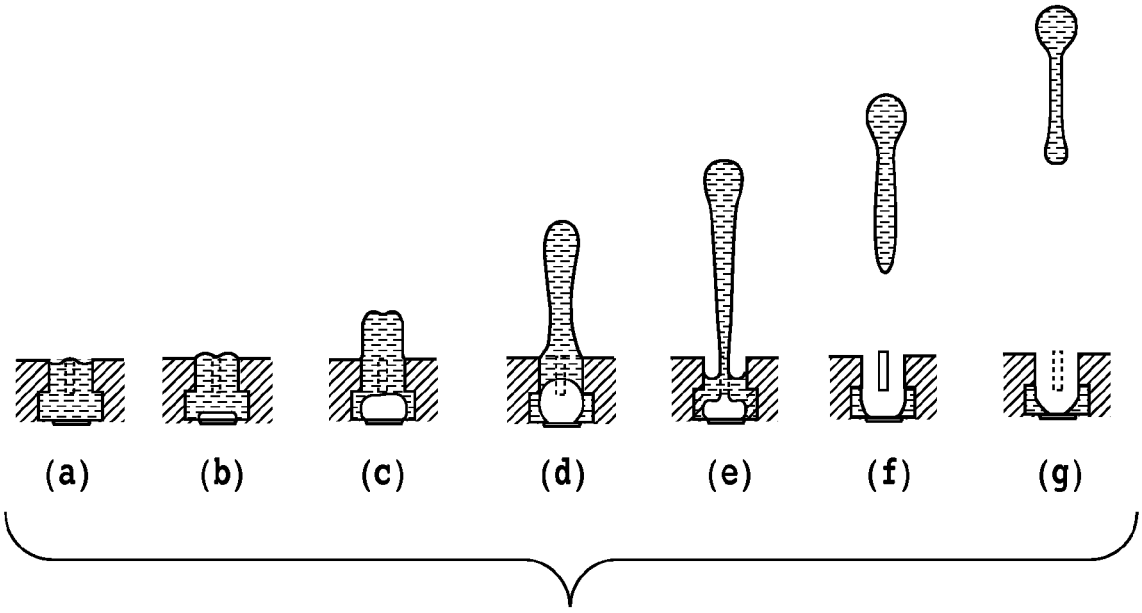
FIG. 9 is a diagram illustrating the ejection sequence at each stage in a bubble-through jet ejection system in which communication of an air bubble with the atmosphere occurs.

FIGS. 8 and 9 are diagrams illustrating the ejection sequence at each stage in the BTJ (bubble-through jet) ejection system in which communication of an air bubble with the atmosphere occurs. The steps at the ejection stages (a) to (g) in FIG. 8 correspond to the steps at the ejection stages (a) to (g) in FIG. 9. A required condition for the BTJ ejection system is a reduction in the distance OH from the heater to the ejection orifice (reduce it to 20 μm to 30 μm) as compared with the distance in the aforementioned example of the BJ ejection system (see FIG. 2A). As a result, an air bubble grows upward (in the direction of the ejection orifice) (FIG. 8(*d*)), and then the meniscus is increasingly retracted into the ejection orifice, to make connection with the air bubble in the nozzle (FIG. 8(*f*)). Such a state, in which the meniscus is easily retracted in the low fluid resistance area, so that the liquid film is formed between the protrusions, occurs in an earlier stage, resulting in a reduction in the time during which the droplet separates.

In the use of the conventional ejection orifice without protrusions, the back end of the tail of ejected droplet is bent and satellite droplets flied away from the trajectory of the main droplet. However, the addition of protrusions as designed by the present invention provides the advantage that the bending of a tail at the separation is inhibited, in addition to the advantage that the time during which the ejected droplet separates is shortened so as to reduce the length of the tail, as compared with the case of a conventional BTJ ejection system. This is because since the separation of a droplet occurs between the protrusions in the ejection orifice, droplets separate at the center of the ejection orifice at all times. The linearity of the trajectory when an ejected droplet flies is maintained, thus making it possible to inhibit formation of satellite droplets and a degradation of a printed image.

(About Shape of Protrusion)

Next, details will be given of the shape of a protrusion used in the present invention. The shape of the protrusion referred to as here is a shape of a protrusion when the ejection orifice is viewed from the direction of ejecting the liquid, that is, relates to a cross-section of the ejection orifice in the direction of ejecting the liquid.

Figure 10:
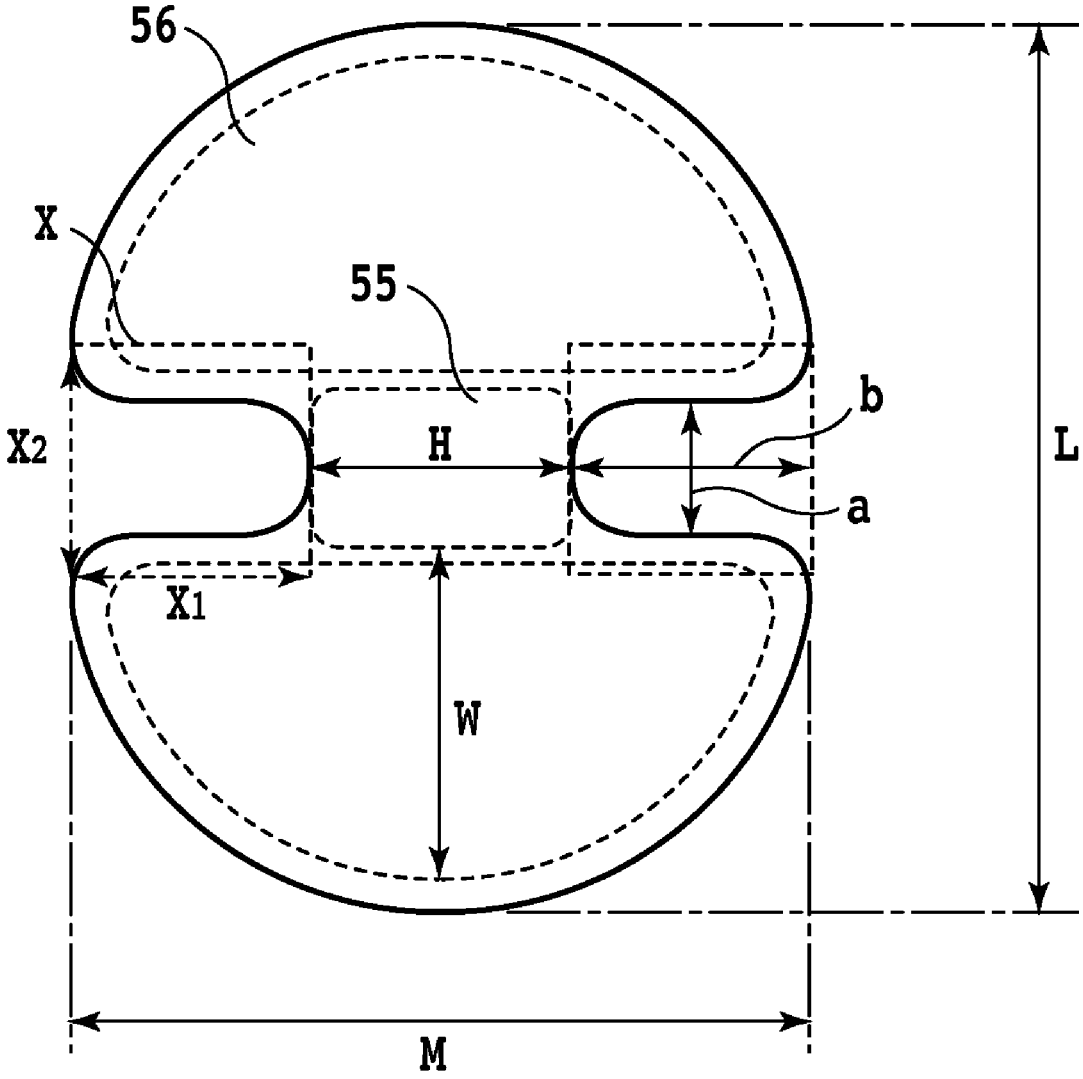
FIG. 10 is a diagram illustrating the shape of an ejection orifice in the embodiment.

FIG. 10 illustrates the shaped of the ejection orifice in the embodiment. For the purpose of forming a high fluid resistance area 55 and a low fluid resistance area 56 for an effective operation, it is desirable that the length W in the low fluid resistance area 56 is longer than the shortest distance (gap between the protrusions) H provided by the protrusions.

When the number of protrusions is two or less and the width of the protrusion, except for the leading portion having a certain curvature and the base portion, is approximately constant, if the following relationship is satisfied, that is, $$M \geqq (L-a)/2 > H$$

where M is the minimum diameter of an outer periphery of the ejection orifice assumed that the protrusions are not formed (the distance from the base of one protrusion to the base of the other and opposite protrusion in the case of the embodiment in which the two protrusions are provided, or the distance from the base of the protrusion to the opposite point on the periphery when only one protrusion is provided), L is the maximum diameter of the ejection orifice, a is a half-width of the protrusion, and H is the distance from the tip of the protrusion to the periphery of the ejection orifice in the direction in which the protrusion projects, the balance between the area of half circles in the ejection orifice and the area between the protrusions becomes suitable for carrying out the ejection method according to the present invention. More preferably, the relationship is $M \geqq (L-a)$. When the gap H between the protrusions exceeds zero so that a liquid film can be held between the protrusions, the ejection method of the embodiment is achieved.

FIG. 10 shows a protrusion area X, which is formed in a rectangular shape or a square shape having two sides; the length of the protrusion in the direction in which the protrusion extends toward the center of the ejection orifice (in which the protrusion protrudes) (X1: the length from the base of the protrusion to the tip thereof), and the width of the base of the protrusion in the width direction of the protrusion (X2: a linear distance from one bending point of the base of the protrusion to the other and opposite bending point beyond the protrusion). If the bending points are uncertain in the linear distance X2, two contact points obtained by drawing a tangent line on the base of the protrusion are considered as the bending points. In the embodiment, when the protrusions are located within in the range of $$0 < X2/X1 \leqq 1.6,$$

it is possible to enhance the force holding the liquid film between the protrusions to such an extent that the meniscus between the protrusions is preferably maintained around the outward open end of the ejection orifice until the droplet separates, thus achieving a reduced length of the tail. When the protrusions are located within the range of $$M \geqq (L-X2)/2 > H,$$

the balance between the area of half circles in the ejection orifice and the area between the protrusions becomes more suitable for carrying out the ejection method according to the present invention.

The present invention reduces the length of a tail of an ejected drop because since a liquid film is formed and held between the protrusions, after the formation of a liquid column, the liquid column separates, in an earlier stage, from the surface of the liquid film facing the outward open end of the ejection orifice so as to be ejected as a droplet. That is, what is important is that a liquid film is held between the protrusions up to the instant at which the droplet separates. For this end it is required that the leading end of the protrusion has a shape capable of easily holding a liquid film formed between the protrusions (easily maintaining the surface tension).

Figure 11:
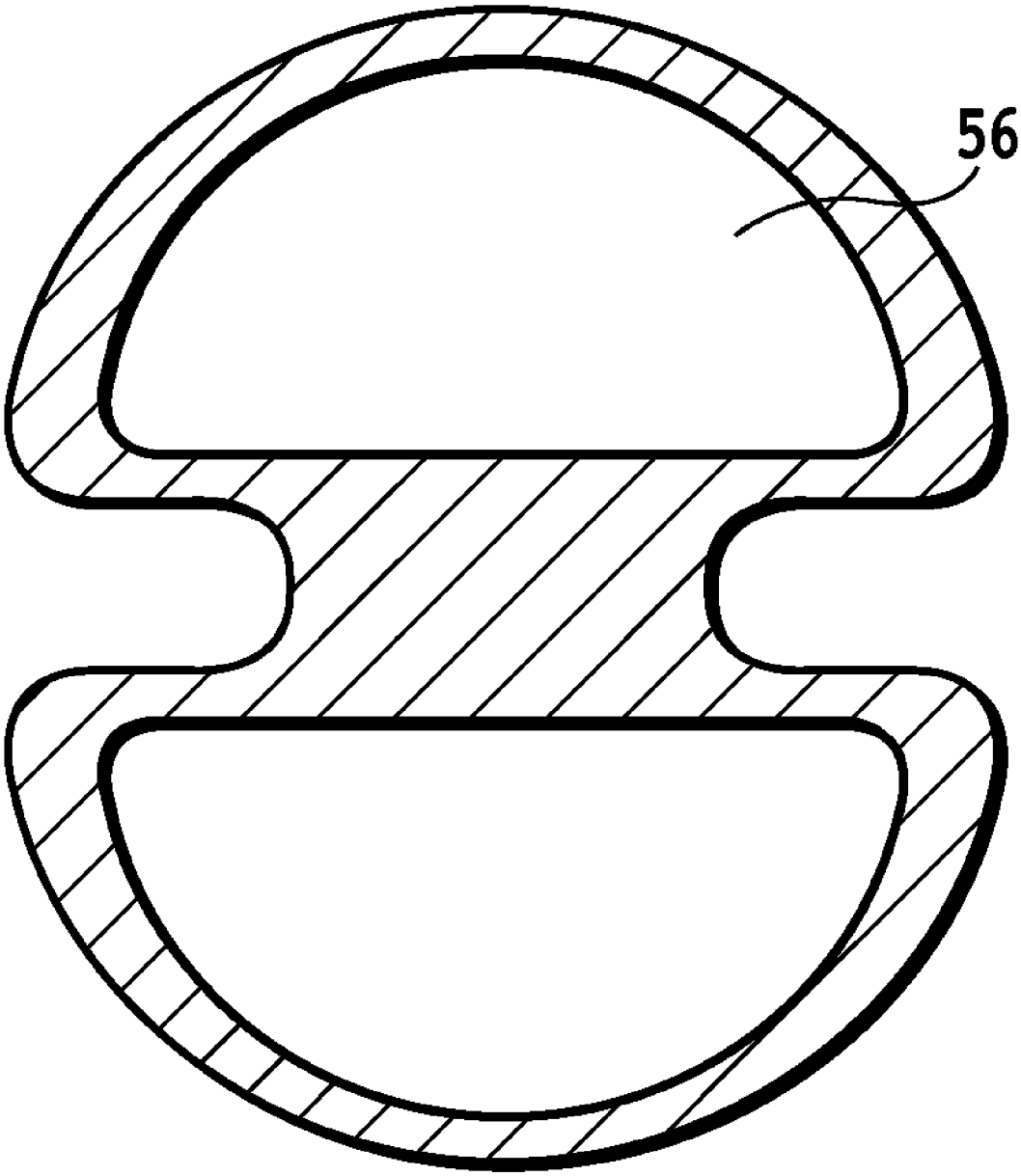
FIG. 11 is a schematic diagram illustrating the liquid movement in the ejection orifice in the bubble shrinkage process in the embodiment.

FIG. 11 is a schematic diagram illustrating the movement of the liquid in the ejection orifice in the bubble shrinkage process. In the ejection orifice of the embodiment, in the bubble shrinkage process, a force acts on the meniscus so as to depress half-circular portions of the meniscus corresponding to the low fluid resistance area 56 illustrated in FIG. 11 toward the heater, so that the liquid film between the protrusions, as indicated by slant lines, is easily held. In addition, if the meniscus has straight line portions extending along the opposing sides of each protrusion and parallel to each other, the meniscus in the low fluid resistance area 56 is easily depressed in half-circular form. The embodiment has described the example of the leading end of the protrusion having a curvature, but the advantages of the embodiment can be provided if the leading end of the protrusion has a shape having a vertical straight line portion in the protruding direction of the protrusion, for example, a quadrangular shape.

Because of such shapes of the protrusion and the ejection orifice as described above, an increased force holding a liquid film formed between the protrusions is achieved as illustrated in the simulations in FIGS. 6B and 6C, and the liquid film is maintained between the protrusions even during formation of a liquid column as illustrated in FIG. 6B and also even after the liquid column separates from the liquid film as illustrated in FIG. 6C. For this reason, a site where the liquid column separates from the liquid film is closer to the outward open end of the ejection orifice, which makes it possible to shorten the length of the tail of the ejected droplet, leading to a reduction in satellite droplets.

As illustrated in the sectional view in FIG. 2A, in the light of the positional symmetry of meniscus and the stability of ejection, the axis of the ejection orifice in the direction of ejecting the liquid is preferably perpendicular to the outward open end of the ejection orifice and the energy generating element. If the axis of the ejection orifice is not perpendicular to the outward open end or the energy generating element, when the meniscus position moves inside the ejection orifice toward the energy generating element in the bubble shrinkage process, the meniscus position extremely lacks symmetry, resulting in difficulty of fully providing the advantages of the present invention.

As described above, in the embodiment, all the ejection orifices, except for the dummy orifices E01 (see FIG. 1), are provided with the protrusions. The four operative ejection orifices 38 located close to each of the ends of each ejection orifice row are defined as end-located ejection orifices. Each of the protrusions provided in the end-located ejection orifices has a shorter length than the length of each of the protrusions provided in the ejection orifices 37 located in the central portion of the nozzle row. As a result, the ejection smoothness after the lapse of a predetermined time period is improved more in the end-located ejection orifices 38 than in the ejection orifices located in the central portion. Thus, satisfactory printing without droplet misdirection and nozzle misfiring in a nozzle row end can be achieved.

In the embodiment, the four operative ejection orifices located close to each of the ends of each ejection orifice row, except for the dummy nozzles, are defined as end-locate dejection orifices. However, the present invention is not limited to this. The number of end-located ejection orifices may be set to a predetermined number depending upon, for example, the physical properties of ink employed.

Second Embodiment

A liquid ejection head in a second embodiment differs in the shape of each of the end-located ejection orifices from the shape of the ejection orifice described in the first embodiment. The structure of other components is similar to that in the liquid ejection head in the first embodiment, and details are omitted.

As in the case of the first embodiment, the liquid ejection head in the second embodiment comprises the end-located ejection orifices and the ejection orifices located in the central portion which are provided with the protrusions. One of the two protrusions provided in each of the end-located ejection orifices is shorter than the other protrusion.

Figure 12:
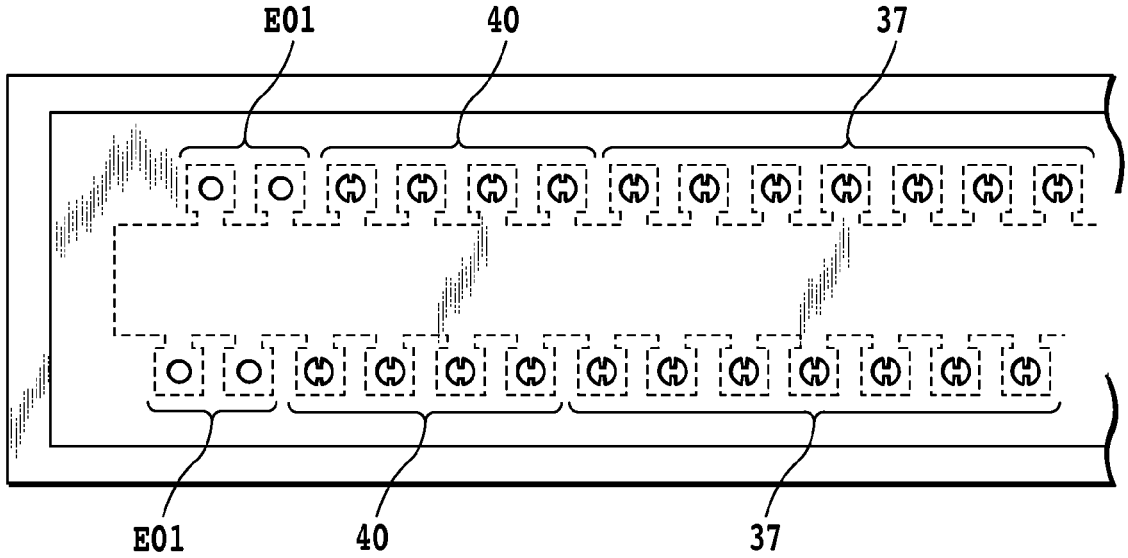
FIG. 12 is a diagram illustrating a part of the liquid ejection head of a second embodiment of the present invention.

FIG. 12 is a diagram illustrating a part of the liquid ejection head of the second embodiment. Each of the end-located ejection orifices 40 are provided with a longer protrusion and a shorter protrusion. In this manner, only in the end-located ejection orifices, one of the protrusions in each ejection orifice is shorter than the other in order to shorten the length of the periphery of the ejection orifice for a reduction in the flow resistance. In consequence, the ejection smoothness after the lapse of a predetermined time period is improved.

Figure 13A:
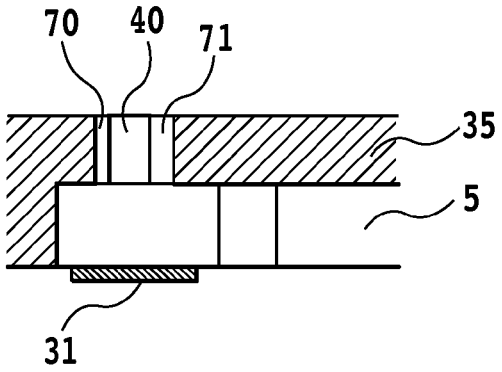
FIG. 13A is a sectional view illustrating an ejecting part of a nozzle having an ejection orifice in the second embodiment.
Figure 13B:
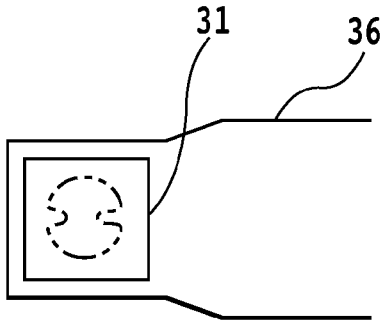
FIG. 13B is a front view of the nozzle of the liquid ejection head in FIG. 13A.
Figure 13C:
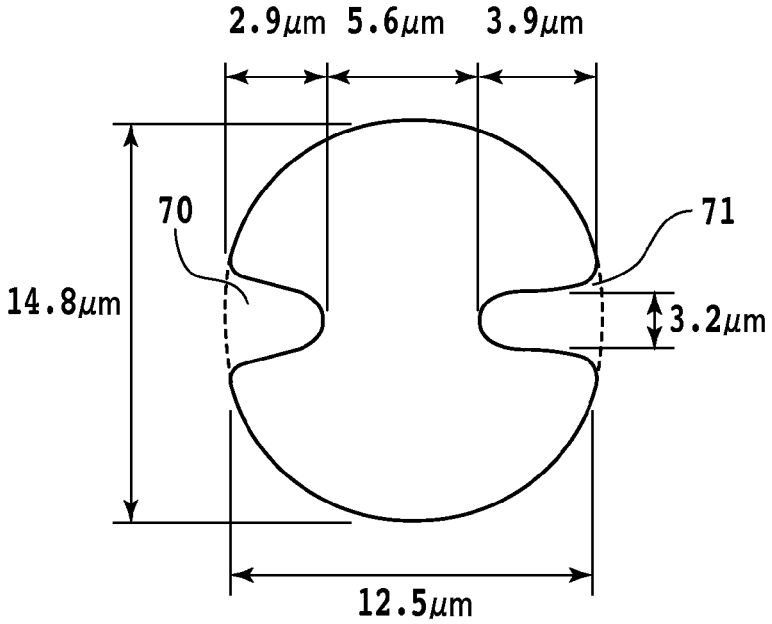
FIG. 13C is a diagram illustrating the shape of the ejection orifice of the liquid ejection head in FIG. 13A.

FIG. 13A is a sectional view illustrating an ejecting part of the nozzle having the ejection orifice in the second embodiment, in which the ejection orifice is provided with a protrusion 70 and a protrusion 71 which differs in length. FIG. 13B is a front view of the nozzle. FIG. 13C is a diagram illustrating the shape of the ejection orifice 40, in which the protrusion 70 has a width of 3.2 μm and a length of 2.9 μm, the protrusion 71 has a width of 3.2 μm and a length of 3.9 μm, and the gap between the protrusions is 5.6 μm.

Figure 14:
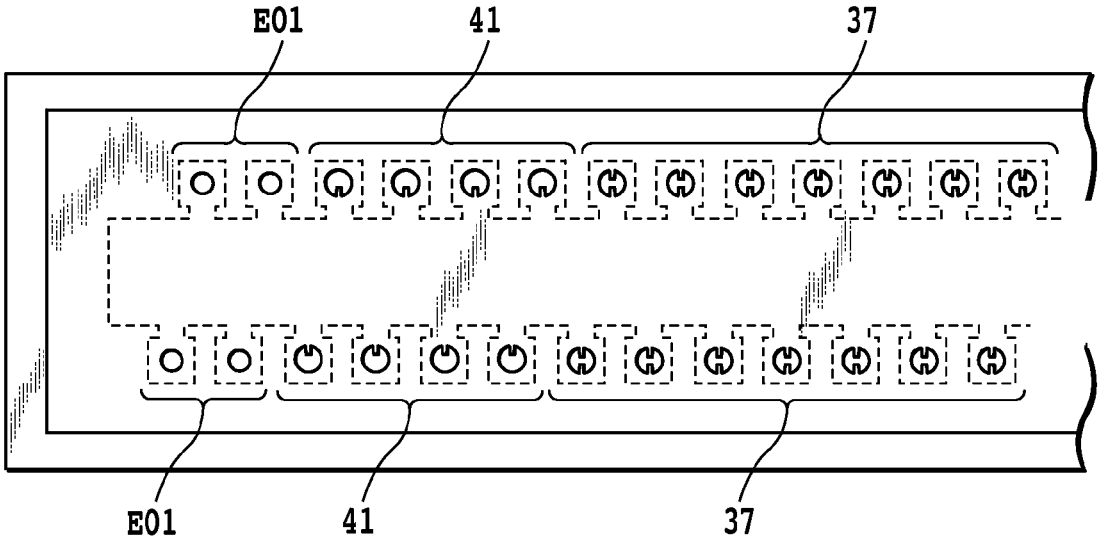
FIG. 14 is a diagram illustrating a part of the liquid ejection head of a modified example of the second embodiment.
Figure 15A:
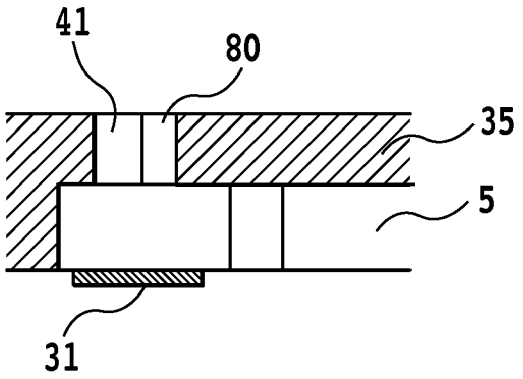
FIG. 15A is a sectional view illustrating an ejecting part of a nozzle having an ejection orifice with a protrusion extending from one side.
Figure 15B:
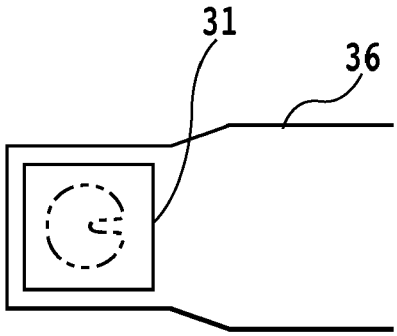
FIG. 15B is a front view of the nozzle of the liquid ejection head in FIG. 15A.
Figure 15C:
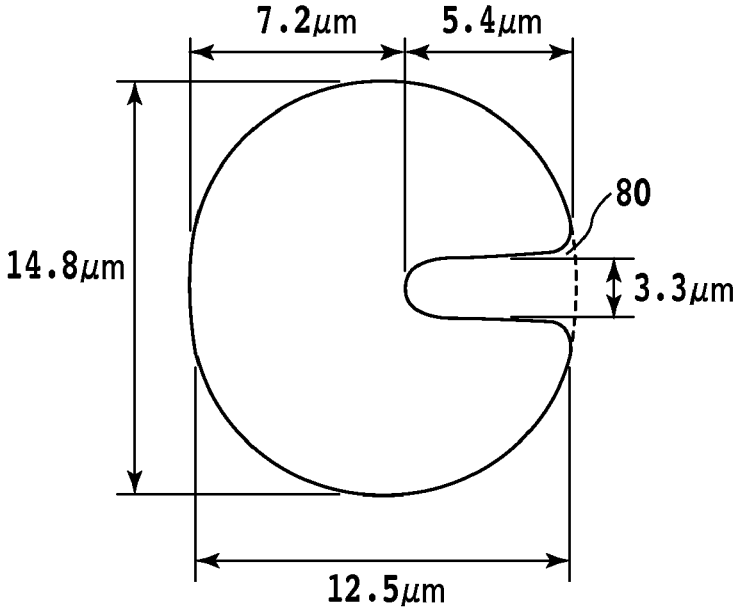
FIG. 15C is a diagram illustrating the shape of the ejection orifice of the liquid ejection head in FIG. 15A.

FIG. 14 is a diagram illustrating a liquid ejection head of a modified example of the second embodiment. In the modified example, each of the end-located ejection orifices is provided with a protrusion, which is the modified example of the aforementioned state of one of the protrusions being short. FIGS. 15A and 15B are diagrams illustrating a nozzle having the ejection orifice of the embodiment. FIG. 15C is a diagram illustrating the shape of an end-located ejection orifice of the embodiment. The protrusion 80 provided in each of the end-located ejection orifices 41 has a width of 3.3 μm and a length of 5.4 μm and the distance between the outer periphery of the ejection orifice and the tip of the protrusion is 7.2 μm. Therefore, the length of the periphery of each of the end-located ejection orifices 41 is shorter than that of each of the ejection orifices located in the central portion of the ejection orifice row. The reduced periphery of the ejection orifice leads to the improvement of the ejection smoothness after the lapse of a predetermined time period.

Each of the end-located ejection orifices is provided with the protrusions differing in length as described above. As a result, the ejection smoothness after the lapse of a predetermined time period is improved more in the end-located ejection orifices than in the ejection orifices located in the central portion. Thus, satisfactory printing without droplet misdirection and nozzle misfiring in a nozzle row end can be achieved.

Third Embodiment

A liquid ejection head in a third embodiment differs in the shape of each of the end-located ejection orifices from the shape of the ejection orifice described in the first embodiment. The structure of other components is similar to that in the first and second embodiments.

Figure 16A:
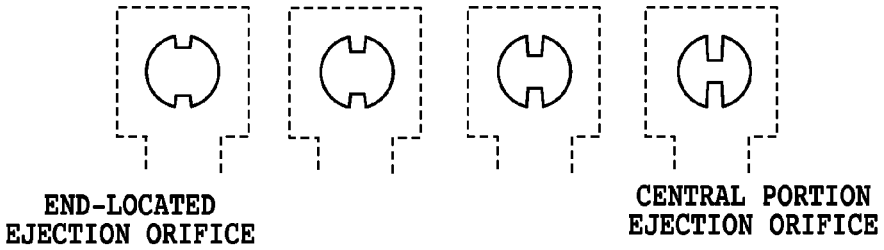
FIG. 16A is a diagram illustrating ejection orifices located close to an end of the liquid ejection head in a third embodiment.
Figure 16B:
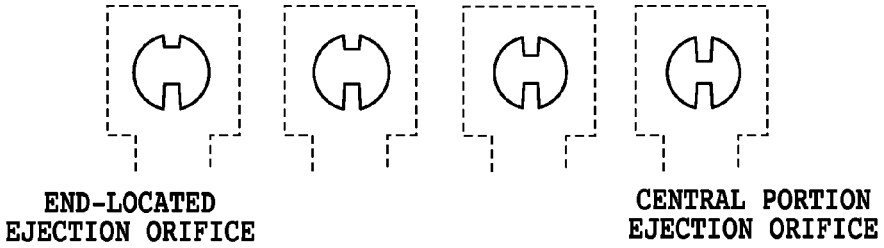
FIG. 16B is a diagram illustrating other ejection orifices located close to an end of the liquid ejection head in a modified example of the third embodiment.

FIG. 16A is a diagram illustrating an end-located ejection orifice in a third embodiment. FIG. 16B is a diagram illustrating an end-located ejection orifice in a modified example of the third embodiment.

In the end-located ejection orifices of the liquid ejection head of the third embodiment, the closer to the end of the ejection orifice row, the shorter the length of the protrusions provided in the end-located ejection orifices as illustrated in FIG. 16A. The closer to the endmost-located ejection orifice, the more easily the defective conditions deteriorating smooth ink-ejection after the lapse of a predetermined time period occur. To avoid this, the ejection orifices provided with the protrusions having the lengths are employed. In FIG. 16A, on the two protrusions in each of the end-located ejection orifices, the protrusions are gradually shortened at the same rate toward the end of the ejection orifice row. However, as illustrated in FIG. 16B, only one of the protrusions in the end-located ejection orifices may be gradually shortened.

By employing the method as described above, the ejection smoothness after the lapse of a predetermined time period can be improved more in the end-located ejection orifices than in the ejection orifices located in the central portion. Thus, satisfactory printing without droplet misdirection and nozzle misfiring in a nozzle row end can be achieved.

Fourth Embodiment

A liquid ejection head in a fourth embodiment differs in the shape of each of the end-located ejection orifices from the shape of the ejection orifice described in the first embodiment. The structure of other components is similar to that in the first, second, and third embodiments.

Figure 17:
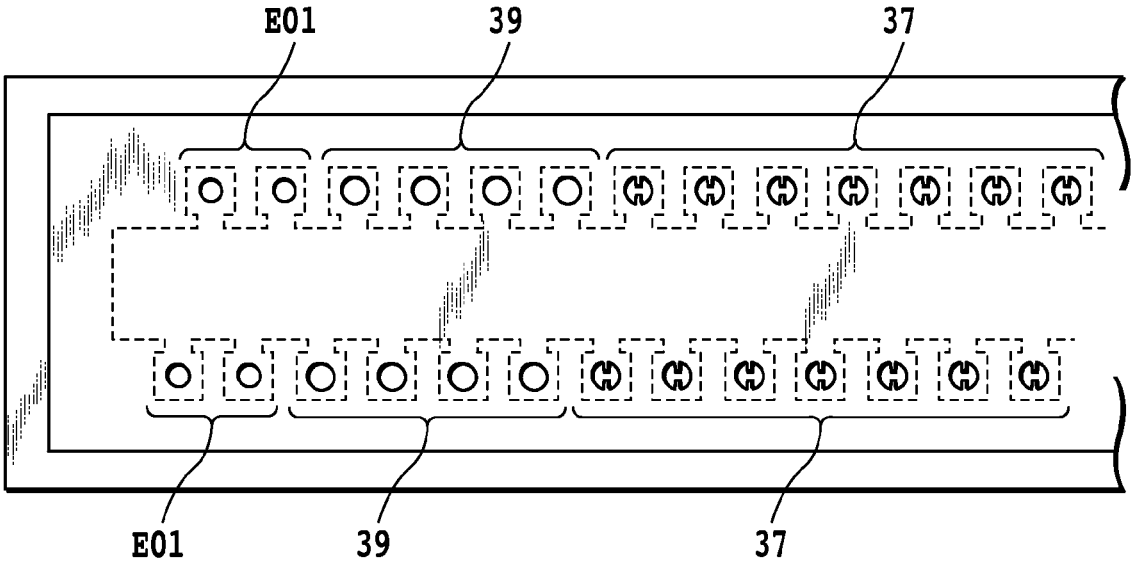
FIG. 17 is a diagram illustrating a part of a liquid ejection head of a fourth embodiment.

FIG. 17 is a diagram illustrating a part of the liquid ejection head of the fourth embodiment. The liquid ejection head according to the fourth embodiment includes circular-shaped end-located ejection orifices 39 without protrusions. This design of each of the end-located ejection orifices 39 formed in a circular shape but not provided with the protrusion achieves the reduced length of the periphery of each end-located ejection orifice in order to improve the ejection smoothness after the elapse of a predetermined time period in the end-located ejection orifices. When the end-located ejection orifice is formed in a circular shape, it differs in shape from the ejection orifices provided with the protrusions and located in the central portion. For this reason, the amount of liquid ejected may possibly differ. However, this can be solved by setting the diameter of the circle of the end-located ejection orifice to a size suitable for equalizing the amount of liquid ejected. A necessity is a reduction in the length of the periphery, so that the end-located ejection orifice may be formed in an oval shape.

By employing the method as described above, the ejection smoothness after the lapse of a predetermined time period can be improved more in the end-located ejection orifices than in the ejection orifices located in the central portion. Thus, satisfactory printing without droplet misdirection and nozzle misfiring in a nozzle row end can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-139177, filed May 25, 2007, which is hereby incorporated by reference herein in its entirety.

What is claimed is:

1. A liquid ejection head comprising a plurality of ejection orifices facilitating ejecting a predetermined amount of liquid therefrom, wherein the plurality of ejection orifices are shaped with reference to a single opening shape defined as a reference opening shape, and wherein the plurality of ejection orifices are arranged to form ejection orifice rows, and each ejection orifice located in a portion of each ejection orifice row other than end portions of the ejection orifice row comprises a protrusion protruding into a center of the ejection orifice of the reference opening shape, whereby the ejection orifice has a longer length of a periphery than that of each ejection orifice located in the end portions of the ejection orifice row.

2. A liquid ejection head according to claim 1, wherein each ejection orifice comprises a pair of opposing protrusions extending from an outer periphery of the ejection orifice of the reference opening shape toward the center of the ejection orifice.

3. A liquid ejection head according to claim 1, wherein the ejection orifices located in the end portions of the ejection orifice row include a predetermined number of ejection orifices beginning with the ejection orifice located at the end of each of the end portions of the ejection orifice row.

4. A liquid ejection head according to claim 1, wherein a length of the protrusion provided in at least one of the ejection orifices located in each end portion of the ejection orifice row is shorter than a length of the protrusion provided in the ejection orifice located in the portion of the ejection orifice row other than the end portions of the ejection orifice row.

5. A liquid ejection head according to claim 2, wherein a length of each pair of protrusions provided in the ejection orifice located in each end portion of the ejection orifice row is shorter than a length of the protrusion provided in the ejection orifice located in the portion of the ejection orifice row other than the end portions of the ejection orifice row.

6. A liquid ejection head according to claim 2, wherein a length of one protrusion of the pair of protrusions provided in the ejection orifice located in each end portion of the ejection orifice row is shorter than a length of the protrusion provided in the ejection orifice located in the portion of the ejection orifice row other than the end portions of the ejection orifice row.

7. A liquid ejection head according to claim 1, wherein the closer to the end of the ejection orifice row, the shorter the length of the protrusion provided in the plurality of ejection orifices located in the end portion of the ejection orifice row.

8. A liquid ejection head according to claim 1, wherein the ejection orifices located in the end portion of the ejection orifice row in which the ejection orifices are arranged are ejection orifices of the reference opening shape having a circular shape.

* * * * *